US006540931B1

(12) United States Patent
Faw et al.

(10) Patent No.: US 6,540,931 B1
(45) Date of Patent: Apr. 1, 2003

(54) REMOVAL OF COPPER KISS FROM PICKLING HIGH COPPER ALLOYS

(75) Inventors: Lawrence E. Faw, Walled Lake, MI (US); Dane G. Armendariz, Pittsburgh, PA (US); John M. Binkley, Southfield, MI (US); Paul F. Davis, New Castle, PA (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/526,219

(22) Filed: Mar. 15, 2000

(51) Int. Cl.[7] ..... C23F 1/00

(52) U.S. Cl. ..... 216/106; 216/105; 216/107; 134/5; 252/79.2; 252/79.3

(58) Field of Search ..... 216/106, 107, 216/105; 134/2, 3; 252/79.2, 79.3

(56) References Cited

U.S. PATENT DOCUMENTS 4,459,216 A * 7/1984 Nakazato et al. ..... 252/79.4
5,364,549 A * 11/1994 McDonogh ..... 252/79.4
5,417,755 A * 5/1995 Pedrazzini ..... 148/269
5,417,775 A 5/1995 Pedrazzini ..... 148/269
5,843,240 A 12/1998 Pedrazzini et al. ..... 134/3
5,908,511 A 6/1999 Bianchi ..... 134/3
6,126,755 A * 10/2000 Colgan et al. ..... 134/3

* cited by examiner

*Primary Examiner*—Benjamin L. Utech
*Assistant Examiner*—Shamim Ahmed
(74) *Attorney, Agent, or Firm*—Stephen D. Harper; Daniel S. Ortiz

(57) ABSTRACT

When iron group, especially high nickel, metal alloys that contain substantial amounts of copper are pickled, a displacement coating of copper that is called a "copper kiss" often forms on the pickled surface from the dissolved copper ions in the pickling solution before the pickling solution can be rinsed away. Traditionally this has been removed by treatment with aqueous ammonia, an annoying and potentially hazardous reagent that in many instances requires expensive pollution abatement devices. In this invention, copper kiss is equally effectively removed by treatment with a mixture of sulfuric acid and hydrogen peroxide, optionally also containing hydrofluoric acid.

18 Claims, No Drawings

REMOVAL OF COPPER KISS FROM PICKLING HIGH COPPER ALLOYS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The general process of removing scale and other soil from the surfaces of metallic objects by acid pickling is well known. Such a process is usually applied to metal alloys that are predominantly constituted of "base" metals, such as iron, nickel, cobalt, aluminum, and/or zinc, which can thermodynamically reduce acid in aqueous solutions to hydrogen gas and replace the hydrogen cations that have been changed to hydrogen gas by dissolved metal cations in the originally acid solution. Some of these alloys also contain "noble" metals, such as copper and silver, that thermodynamically can not displace hydrogen gas from simple aqueous acid solutions as base metals can. The noble metals are nevertheless dissolved in the pickling solutions along with the base metals in the alloys pickled, and it is known in the art that when many such alloys are pickled, copper and any other noble metals dissolved in the pickling solutions usually at least partially redeposit in metallic form on the pickled surfaces before the used pickling solution can practically be rinsed away. This surface layer of displacement plated noble metal is usually described in the art as a "copper kiss" and is usually not acceptable as a final pickled surface.

It is now customary in the art to remove copper kiss from initially pickled surfaces by contact with a strong solution of aqueous ammonia. This material is notoriously unpleasant in odor, because it is in equilibrium with a substantial partial pressure of gaseous ammonia, which has a pungently unpleasant smell and can pose a significant health hazard to workers if mixed with air breathed by the workers. To avoid air pollution, a fume scrubber is generally needed as part of the system for removing the ammonia gas from respirable air. Thus this established method of removing copper kiss is annoying, hazardous, and expensive.

Accordingly, a major object of this invention is to provide an alternative method, and any needed materials for use therein, for removing copper kiss from pickled metal surfaces, the alternative method overcoming at least one, more preferably more than one, and most preferably all, of these disadvantageous characteristics of the use of aqueous ammonia for the purpose. Other more detailed alternative and/or concurrent objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the objects of the invention; the terms "molecule" and "mole" and their grammatical variations may be applied to ionic, elemental, or any other type of chemical entities defined by the number of atoms of each type present therein, as well as to substances with well-defined neutral molecules, and "mole" means specifically "gram mole"; the first definition of an acronym or other abbreviation applies to all subsequent uses herein of the same abbreviation; and the term "polymer" includes "oligomer", "homopolymer", "copolymer", "terpolymer", and the like.

BRIEF SUMMARY OF THE INVENTION

It has been found that an aqueous solution containing suitable concentrations of sulfuric acid and hydrogen peroxide is at least as effective as conventional aqueous ammonia for removing copper kiss from pickled surfaces. At least in its preferred embodiments, this type of aqueous solution has no unpleasant odor, presents no known atmospheric health hazard, and does not require expensive pollution abatement equipment when used. Various embodiments of the invention include liquid working compositions for direct use in treating metals, processes for treating metals with a composition according to the invention, and extended processes including additional operations that may be conventional per se, such as initial pickling to produce the copper kiss surface.

BRIEF DESCRIPTION OF THE DRAWINGS

Not applicable.

DETAILED DESCRIPTION OF THE INVENTION AND PREFERRED EMBODIMENTS

A working composition according to the invention comprises, preferably consists essentially of, or more preferably consists of, water and:

(A) a concentration of dissolved $H_2SO_4$ that is at least, with increasing preference in the order given, 0.5, 1.0, 1.5, 2.0, 2.5, 3.0, 3.5, 4.0, 4.5, or 5.0 percent and independently preferably, at least for economy, is not more than 15, 10, 9.0, 8.0, 7.0, 6.5, 6.0, 5.5, or 5.2 percent; and (B) a concentration of dissolved $H_2O_2$ that is at least, with increasing preference in the order given, 0.2, 0.5, 0.8, 1.1, 1.4, 1.7, 2.1, 2.3, 2.5, 2.7, or 2.9 percent and independently preferably, at least for economy, is not more than, with increasing preference in the order given, 6.5, 5.5, 4.5, 3.5, or 3.1 percent; and, optionally, (C) a concentration of dissolved HF that preferably, at least for economy, is not more than, with increasing preference in the order given, 6.0, 5.0, 4.0, 3.5, 3.0, 2.5, 2.0, 1.5, or 1.0 percent and independently, when greater than zero, preferably is at least, with increasing preference in the order given, 0.10, 0.20, 0.30, 0.40, 0.50, 0.60, 0.70, or 0.80 percent.

Ordinarily, for convenience and economy, hydrogen peroxide is sourced to a composition according to the invention from a commercially available aqueous solution of hydrogen peroxide. However, it is known to those skilled in the art that hydrogen peroxide can be effectively supplied to aqueous solutions by adding other peroxides and allowing them to hydrolyze to hydrogen peroxide in the solution. It is also known that various stabilizers of hydrogen peroxide that retard its spontaneous decomposition may be added to an aqueous solution of hydrogen peroxide to improve its storage stability, and inclusion of such stabilizers is within the scope of a composition according to this invention.

In a process according to the invention, a surface having at least some part thereof bearing a coating of displacement plated copper or other noble metal is preferably contacted with a liquid composition according to the invention as described above. The temperature of the composition during its contact with the surface to be freed of copper kiss is not critical and may range from the freezing point to the boiling point of the liquid. At least for convenience and economy, the temperature most preferably is within the range of normal human comfort ambient temperature, i.e., from 18 to 25° C. The time should be sufficient to accomplish the removal of the copper kiss to the extent needed for the application envisaged for the finally pickled object. As little as 3 seconds (this unit being hereinafter usually abbreviated as "sec") may be sufficient, and no more than 2 minutes (this unit being hereinafter usually abbreviated as "min") would generally be needed, in contrast to the times of at least 10 and often as much as 30 min normally used for primary pickling.

For a variety of reasons, it is sometimes preferred that compositions according to the invention as defined above should be substantially free from many ingredients used in compositions for similar purposes in the prior art. Specifically, it is preferred, with increasing preference in the order given, independently for each preferably minimized component listed below, that these compositions contain no more than 10, 5, 3, 1.0, 0.35, 0.10, 0.08, 0.04, 0.02, 0.01, 0.001, or 0.0002, percent of each of the following constituents: nitrate; nitric acid; nitrite; nitrous acid; halates and perhalates (i.e., perchlorate, chlorate, iodate, etc.); chloride; bromide; iodide; organic compounds containing nitro groups; organic molecules each of which contains at least two moieties selected from the group consisting of carboxyl, carboxylate, hydroxyl, peroxy, keto, aldehydo, amino, amido, substituted amido, nitrile, substituted amino, thio, ether, thioether, phosphino, and substituted phosphino moieties; hexavalent chromium; manganese in a valence state of four or greater; metal cations, other than those dissolved from the substrates being treated, with a valence of two or more; ferricyanide; ferrocyanide; and pyrazole compounds. Even though components such as these may not be harmful in some cases, they have not been found to be needed or advantageous in compositions according to this invention, and their minimization will therefore normally be preferred for economy A process according to the invention may be used to remove any layer of relatively noble metal on the surface of a baser metal or alloy that is sufficiently passivated by the peroxide content of a composition according to the invention to avoid substantial dissolution of the baser metal or alloy. However, as already partially indicated above, it is most advantageously, and therefore preferably, applied to removing copper kiss formed by a preliminary pickling of alloys of the types often identified by the trademarks MONEL™ and INCONEL™. Nickel and/or cobalt is the most predominant metal in these alloys, but they also contain substantial minor fractions of copper. Any type of initial pickling known in the art usually leaves on the initially pickled surface a copper kiss contamination that this invention is well adapted to remove. This invention is perhaps most advantageously adapted to removing the copper kiss coating left by initial pickling as taught in one or more of U.S. Pat. Nos. 5,417,775, 5,843,240, and 5,908,511, the entire disclosures of which, exclusive of their teachings of prior art and of anything that might be inconsistent with any explicit statement herein, are hereby incorporated herein by reference.

The practice of this invention may be further appreciated by consideration of the following, non-limiting, working examples.

EXAMPLE 1

Heat treated MONEL™ 400 alloy was pickled successively in a 30% solution of $H_2SO_4$ in water for 30 min, then a solution of $H_2SO_4$, NaCl, $NaNO_3$, and $FeCl_3$ in water for 2.0 min, and finally a solution in water of $H_2SO_4$ and NaCl for 1.0 min. All scale was removed, but a copper kiss was present. This was removed by immersion for 5 sec at ambient human comfort temperature in a solution in water of 50 grams of $H_2SO_4$ per liter of solution (this unit of concentration being hereinafter usually abbreviated as "g/l") and 30 g/l of $H_2O_2$. A high quality pickled surface resulted.

EXAMPLE 2

Heat treated MONEL™ 400 and nickel type 205 alloys were pickled in a solution in water of 132 g/l of $H_2SO_4$, 39 g/l of HF, 20–25 g/l of iron cations, and sufficient hydrogen peroxide to give the solution an oxidation-reduction potential of 404 millivolts more oxidizing than a standard hydrogen electrode. A copper kiss that formed after pickling was easily removed afterward by dipping in a solution of $H_2SO_4$ and $H_2O_2$ with the same concentrations as described in Example 1.

EXAMPLE 3

A large coil of commercially pickled nickeliferous alloy wire bearing a copper kiss was immersed, while still hot from being pickled at 82° C., into about 750 liters of a solution in water of 41.9 g/l of $H_2SO_4$, 9.7 g/l of HF, and 42.7 g/l of $H_2O_2$. After about 90 seconds, the coil was removed for a short inspection and then reimmersed for another 90–120 sec. After this time, the copper kiss had been sufficiently well removed to pass inspection for commercial use.

The invention claimed is:

1. A process for removing from a metallic surface a coating of copper or another metal more electrochemically noble than copper by contacting said coating with an aqueous liquid composition of matter that comprises water and:

(A) dissolved sulfuric acid; and (B) dissolved hydrogen peroxide, said contacting removing said coating by chemical reaction therewith in a time not greater than 10 minutes.

2. A process according to claim 1, wherein said aqueous liquid composition of matter additionally comprises dissolved hydrofluoric acid.

3. A process according to claim 2, wherein in said aqueous liquid composition of matter there are a concentration of dissolved sulfuric acid that is from about 1.0 to about 15%, a concentration of dissolved hydrogen peroxide that is from about 0.5 to about 6.5%, and a concentration of dissolved hydrofluoric acid that is from about 0.20 to about 0.80%.

4. A process according to claim 1, wherein in said aqueous liquid composition of matter there are a concentration of dissolved sulfuric acid that is from about 1.0 to about 15% and a concentration of dissolved hydrogen peroxide that is from about 0.10 to about 6.5%.

5. A process according to claim 4, wherein in said aqueous liquid composition of matter there are a concentration of dissolved sulfuric acid that is from about 2.5 to about 10% and a concentration of dissolved hydrogen peroxide that is from about 1.4 to about 6.0%.

6. A process according to claim 3, wherein in said aqueous liquid composition of matter there are a concentration of dissolved sulfuric acid that is from about 2.5 to about 10%, a concentration of dissolved hydrogen peroxide that is from about 1.4 to about 6.0%, and a concentration of dissolved hydrofluoric acid that is not more than about 2.5%.

7. A process according to claim 6, wherein said coating has been formed by displacement plating from a pickling solution previously used to treat said metallic surface.

8. A process according to claim 5, wherein said coating has been formed by displacement plating from a pickling solution previously used to treat said metallic surface.

9. A process according to claim 4, wherein said coating has been formed by displacement plating from a pickling solution previously used to treat said metallic surface.

10. A process according to claim 3, wherein said coating has been formed by displacement plating from a pickling solution previously used to treat said metallic surface.

11. A process according to claim 2, wherein said coating has been formed by displacement plating from a pickling solution previously used to treat said metallic surface.

12. A process according to claim 1, wherein said coating has been formed by displacement plating from a pickling solution previously used to treat said metallic surface.

13. A process according to claim 12, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

14. A process according to claim 11, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

15. A process according to claim 10, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

16. A process according to claim 9, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

17. A process according to claim 8, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

18. A process according to claim 7, wherein said pickling solution consisted essentially of water, dissolved sulfuric acid, dissolved hydrofluoric acid, and dissolved ferric cations, and, optionally, one or more of: gaseous oxygen; hydrogen peroxide; and metal cations dissolved during the pickling.

* * * * *